US009903158B2

(12) United States Patent
Guan

(10) Patent No.: US 9,903,158 B2
(45) Date of Patent: Feb. 27, 2018

(54) WINDOW COVERING

(71) Applicant: Dongguan Xindayuan Window Covering Products Co., Ltd., Dongguan, Guangdong (CN)

(72) Inventor: Jianmin Guan, Guangdong (CN)

(73) Assignee: Dongguan Xindayuan Window Covering Products Co., Ltd., Dongguan (CN)

( * ) Notice: Subject to any disclaimer, the term of this patent is extended or adjusted under 35 U.S.C. 154(b) by 0 days.

(21) Appl. No.: 15/067,376

(22) Filed: Mar. 11, 2016

(65) Prior Publication Data

US 2017/0254143 A1 Sep. 7, 2017

(30) Foreign Application Priority Data

Mar. 4, 2016 (CN) ..... 2016 2 0169763 U

(51) Int. Cl.

| | |
|---|---|
| ***E06B 9/32*** | (2006.01) |
| ***E06B 9/322*** | (2006.01) |
| ***E06B 9/307*** | (2006.01) |
| *E06B 9/80* | (2006.01) |

(52) U.S. Cl.

CPC ..... *E06B 9/322* (2013.01); *E06B 9/307* (2013.01); *E06B 9/80* (2013.01); *E06B 2009/807* (2013.01)

(58) Field of Classification Search

CPC ..... E06B 2009/807; E06B 9/80; E06B 9/322; E06B 9/307; E06B 9/304

USPC ..... 160/170, 168.1 R, 173 R, 178.1 R, 296

See application file for complete search history.

(56) References Cited

U.S. PATENT DOCUMENTS

| | | | | | |
|---|---|---|---|---|---|
| 2,381,060 | A * | 8/1945 | Kahn | E06B 9/304 | 160/168.1 R |
| 3,480,227 | A * | 11/1969 | Matthews | E05F 1/16 | 16/78 |
| 6,012,506 | A * | 1/2000 | Wang | E06B 9/30 | 160/170 |
| 6,056,036 | A * | 5/2000 | Todd | E06B 9/262 | 160/84.01 |

(Continued)

FOREIGN PATENT DOCUMENTS

| | | | | |
|---|---|---|---|---|
| AT | 12195 U1 * | 12/2011 | ..... | E06B 9/304 |
| CH | 702335 A1 * | 6/2011 | ..... | E06B 9/304 |

*Primary Examiner* — Katherine W Mitchell
*Assistant Examiner* — Johnnie A. Shablack
(74) *Attorney, Agent, or Firm* — Honigman Miller Schwartz and Cohn LLP; Matthew H. Szalach; Jonathan P. O'Brien

(57) ABSTRACT

A window covering is provided according to the present application, to achieve automatic extending or retracting of a window covering curtain. The window covering includes: a rotating shaft for extending and retracting control, a wound sheet spring and a cord winding box. The extending and retracting of the window covering curtain is achieved by winding the curtain pull cord via the cord winding box, and the force transmission between the wound sheet spring and the cord winding box is achieved by gear transmission. A spring wound sheet is provided inside the wound sheet spring. One proper wound sheet spring is chosen according to the weight of the window covering curtain to allow the window covering curtain to maintain a balance state of force without under the effect of an external force, to fix the extending or retracting state of the window covering curtain.

6 Claims, 2 Drawing Sheets

(56) References Cited

U.S. PATENT DOCUMENTS 6,283,192 B1 * 9/2001 Toti ..... E06B 9/30 160/170
6,293,329 B1 * 9/2001 Toti ..... E06B 9/322 160/168.1 R
6,536,503 B1 * 3/2003 Anderson ..... E06B 9/262 160/170
6,601,635 B2 * 8/2003 Ciuca ..... E06B 9/32 160/170
6,648,050 B1 * 11/2003 Toti ..... E06B 9/322 160/170
6,962,187 B2 * 11/2005 Gilmore ..... E06B 9/322 160/170
6,968,884 B2 * 11/2005 Anderson ..... E06B 9/262 160/170
7,185,691 B2 * 3/2007 Toti ..... E06B 9/262 160/170
7,281,563 B2 * 10/2007 Wu ..... E06B 9/388 160/170
7,287,570 B2 * 10/2007 Strand ..... E06B 9/322 160/171
7,311,133 B2 * 12/2007 Anderson ..... E06B 9/262 160/170
7,686,059 B2 * 3/2010 Jarosinski ..... E06B 9/322 160/167 R
7,802,608 B2 * 9/2010 Anderson ..... E06B 9/262 160/170
7,866,367 B2 * 1/2011 Liang ..... E06B 9/307 160/170
7,886,803 B2 * 2/2011 Anderson ..... E06B 9/262 160/170
7,950,514 B1 * 5/2011 Nurnberg ..... H02P 3/16 198/322
8,002,012 B2 * 8/2011 Cheng ..... E06B 9/303 160/170
8,230,896 B2 * 7/2012 Anderson ..... E06B 9/262 160/170
8,365,797 B2 * 2/2013 Drew ..... E06B 9/262 160/173 R
8,511,364 B2 * 8/2013 Anderson ..... E06B 9/262 160/84.05
8,573,281 B2 * 11/2013 Drew ..... E06B 9/262 160/173 R
8,720,525 B2 * 5/2014 Toti ..... E06B 9/322 160/170
8,723,466 B2 * 5/2014 Chambers ..... E06B 9/304 160/166.1
8,752,607 B2 * 6/2014 Anderson ..... E06B 9/262 160/171
8,820,385 B2 * 9/2014 Wu ..... E06B 9/322 160/170
8,887,788 B2 * 11/2014 Toti ..... E06B 9/322 160/170
8,997,827 B2 * 4/2015 Anderson ..... E06B 9/262 160/170
9,062,492 B2 * 6/2015 Yu ..... E06B 9/322
9,151,109 B2 * 10/2015 Kawai ..... E06B 9/262
9,217,282 B2 * 12/2015 Defenbaugh ..... E06B 9/68
9,217,284 B2 * 12/2015 Panseri ..... E05D 13/003
9,309,716 B2 * 4/2016 Chen ..... E06B 9/322
9,476,254 B2 * 10/2016 Safarik ..... E06B 9/26
2004/0163774 A1 * 8/2004 Nien ..... E06B 9/307 160/168.1 P
2007/0163727 A1 * 7/2007 Cheng ..... E06B 9/30 160/170
2007/0261798 A1 * 11/2007 Hung ..... E06B 9/322 160/170
2009/0120592 A1 * 5/2009 Lesperance ..... E06B 9/322 160/84.02
2010/0302772 A1 * 12/2010 Lin ..... E06B 9/304 362/231
2011/0277943 A1 * 11/2011 Lin ..... E06B 9/262 160/84.04
2012/0118515 A1 * 5/2012 Chen ..... E06B 9/303 160/170
2013/0192774 A1 * 8/2013 Lin ..... E06B 9/322 160/340
2013/0248125 A1 * 9/2013 Lin ..... E06B 9/262 160/84.05
2013/0340949 A1 * 12/2013 Anderson ..... E06B 9/262 160/84.02
2015/0028144 A1 * 1/2015 Defenbaugh ..... E06B 9/322 242/378.4
2015/0176329 A1 * 6/2015 Chen ..... E06B 9/322 160/176.1 R
2015/0345218 A1 * 12/2015 Hall ..... G01R 19/0092 160/168.1 P
2016/0053534 A1 * 2/2016 Chang ..... E06B 9/322 160/168.1 P
2016/0201388 A1 * 7/2016 Wen ..... E06B 9/307 160/176.1 P
2016/0222722 A1 * 8/2016 Schulman ..... E06B 9/322
2016/0222723 A1 * 8/2016 Morris ..... E06B 9/262
2017/0016274 A1 * 1/2017 Zheng ..... E06B 9/304
2017/0067288 A1 * 3/2017 Nien ..... E06B 9/322
2017/0081912 A1 * 3/2017 Guillory ..... E06B 9/26
2017/0081914 A1 * 3/2017 Wu ..... E06B 9/266

* cited by examiner

WINDOW COVERING

This application claims the benefit of priority to Chinese Patent Application No. 201620169763.3 titled "WINDOW COVERING", filed with the Chinese State Intellectual Property Office on Mar. 4, 2016, the entire disclosure of which is incorporated herein by reference.

FIELD

This application relates to the technical field of window coverings, and more particularly to a window covering which is capable of automatically winding a window covering curtain.

BACKGROUND

Window coverings are made of plastics, cloth, linen, gauze, aluminum sheet, wood chip, metal materials and so on, which have functions of sunshade, heat insulation, and indoor light adjustment. According to the control manners of the window coverings, the window coverings may be generally classified into window coverings with manually operated curtain pull cords and window coverings with electrically operated curtain pull cords. The window coverings with manually operated curtain pull cords further include: manually opened-and-closed window coverings, roller blinds with manually operated pull beaded-chains, manually operated silky hanged window coverings, manually operated window blinds, manually operated Roman blinds, manually operated organ shade and the like. The window coverings with electrically operated curtain pull cord include electrically opened-and-closed window coverings, electrically operated roller blinds, electrically operated silky venetian blinds, electrically operated sky-light blinds, electrically operated window blinds, electrically operated Roman blinds, electrically operated organ shade and the like. With their development, the window coverings have become an indoor decoration in combination with functionality and decorativeness perfectly which are indispensible for households.

In the conventional technology, manually operated window coverings generally control the reeling up or retracting of window covering curtains by manually operated pull cords. In this method, control of the pull cord is required to be manually performed, thus the pull cord is generally arranged at a position with a small height, and is easily touched by a child. If the pull cord winds the neck of the child, the life safety of the child may be threatened. The electrically operated window coverings, though is controlled by motors or other electric apparatus rather than through the operation of the manually operated curtain pull cords, the window coverings of such kind doubtlessly increase a production cost thereof, and also the motors generally need to be periodically maintained, thus needing to pay a certain maintenance cost, for example, adding lubricating oil, etc., and furthermore, for an ordinary user, the detachment and maintenance are troublesome.

SUMMARY

An object of the present application is to provide a window covering, to solve the above technical issues.

To achieve this object, the following technical solutions are adopted by the present application.

A window covering, includes a rotating shaft for extending and retracting control, a wound sheet spring and a cord winding box;

the wound sheet spring includes a spring sheet, an elastic force transmission shaft, a first transmission gear, and a second transmission gear; the spring sheet is wound around the elastic force transmission shaft; the first transmission gear is fixedly connected to the elastic force transmission shaft; the second transmission gear is connected to the first transmission gear by meshing; and the second transmission gear is sleeved on the rotating shaft for extending and retracting control; and the cord winding box includes a winding reel, a third transmission gear, and a fourth transmission gear; the winding reel is wound thereon with a curtain pull cord of the window covering; the third transmission gear is fixedly connected to the winding reel; the fourth transmission gear is connected to the third transmission gear by meshing; and the fourth transmission gear is sleeved on the rotating shaft for extending and retracting control.

The curtain according to the embodiment of the present application realizes the extending and retracting of the window covering curtain by winding the curtain pull cord via the cord winding box, and realizes the force transmission between the wound sheet spring and the cord winding box by gear transmission. An elastic wound sheet is provided inside the wound sheet spring, and the wound sheet may generate an elastic force by winding. One or more proper wound sheet spring is chosen according to a weight of the window covering curtain to allow the window covering curtain to maintain a balance state of force without being under the effect of an external force, to fix the extending or retracting state of the window covering curtain. Specifically, the number of the wound sheet springs may be adaptively adjusted according to the weight of the window covering curtain. If it is required to extend or retract the window covering, the balance state of force may be broken by only moving the wind covering curtain with an external force, and the automatic extending and retracting of the window covering curtain may then be achieved, which is convenient. Furthermore, no additional motor or electric control apparatus is required to be provided for this structure, thus doubtlessly reducing the cost of automatically winding the window covering.

In this embodiment, in the case that the window covering curtain receives an upward external force, the window covering curtain is retracted upward, the fourth transmission gear rotates to drive the third transmission gear to rotate, and the third transmission gear rotates to drive the winding reel to rotate, thus controlling the retracting of the curtain pull cord. In the case that the window covering curtain receives a downward eternal force, the window covering curtain is extended downward, the fourth transmission gear rotates to drive the third transmission gear to rotate, and the third transmission gear rotates to drive the winding reel to rotate, thus further controlling the extending of the curtain pull cord. In the case that the upward or downward external force is removed, the elastic force of the wound sheet spring may allow the first transmission gear to stop rotating. Due to rotating of the first transmission gear and the second transmission gear, and the transmission of the third transmission gear and the fourth transmission gear, the third transmission gear may be limited to stop rotating by the wound sheet spring, and further the winding reel is allowed to stop rotating, to fix the extending or retracting state of the window covering curtain.

Preferably, the window covering further includes a speed limiter; the speed limiter includes a fifth transmission gear, a sixth transmission gear, a speed limiting member, a speed limiting transmission shaft, and a fastener;

a first shaft connecting hole is provided at a central portion of the sixth transmission gear, and the sixth transmission gear is sleeved on the rotating shaft for extending and retracting control via the first shaft connecting hole;

the sixth transmission gear is connected to the fifth transmission gear by meshing; and the speed limiting transmission shaft is fixedly connected to the fifth transmission gear; and the speed limiting member is sleeved on a periphery of the speed limiting transmission shaft; the speed limiting member includes a connecting portion for speed limiting control; and the fastener is configured to connect the connecting portion for speed limiting control.

In this embodiment, considering that it is difficult to perfectly match the wound sheet spring and the window covering curtain, the elastic force of the wound sheet spring is either greater or less than the weight of the window covering curtain, such that the extent of extending and retracting of the window covering curtain cannot be fixed. Therefore, the speed limiter is provided on the rotating shaft for extending and retracting control. The speed limiter can provide a certain resistance for the rotation of the rotating shaft for extending and retracting control, to further limit the rotation of the rotating shaft for extending and retracting control, and can have an effect similar to braking. In this embodiment, the tightness of the connecting portion for speed limiting control may be adjusted by the fastener, and further the extent of the speed limiting member abutting against the periphery of the speed limiting transmission shaft may be adjusted, thus generating a proper resistance, which is very convenient.

Preferably, the speed limiting member is an elastic rubber sheet.

Preferably, a first intermediate transmission gear is further provided between the first transmission gear and the second transmission gear; a second intermediate transmission gear is further provided between the third transmission gear and the fourth transmission gear; and the first intermediate transmission gear is connected by meshing to the first transmission gear and the second transmission gear respectively, and the second intermediate transmission gear is connected by meshing to the third transmission gear and the fourth transmission gear respectively.

Preferably, a third intermediate transmission gear is further provided between the fifth transmission gear and the sixth transmission gear; and the third intermediate transmission gear is connected by meshing to the fifth transmission gear and the sixth transmission gear respectively.

In this embodiment, since there are two rotating shafts, i.e., the rotating shaft for curtain state control and the rotating shaft for extending and retracting control, the distance between the two rotating shafts may be adjusted according to different requirements. In the case that the distance is too large, it may be required to add one or even more intermediate transmission gears to perform the transmission, to meet different dimension requirements.

Preferably, the window covering further includes a window covering curtain, and a pull cord connecting hole is provided in the window covering curtain; and the curtain pull cord is connected to the window covering curtain via the pull cord connecting hole.

Preferably, the window covering further includes a rotating shaft for curtain state control and a curtain state controller;

the curtain state controller is fixedly connected to the rotating shaft for curtain state control; and the rotating shaft for curtain state control rotates to drive the curtain state controller to rotate.

Specifically, the window covering curtain is further provided with a curtain state adjusting ladder cord. The curtain state adjusting ladder cord is connected to the curtain state controller. The curtain state controller rotates to drive the curtain state adjusting ladder cord to move up and down, thus may further adjust the state of the window covering curtain.

The beneficiary effects of the present application are as follows. In the present application, the extending and retracting of the window covering curtain is achieved by winding the curtain pull cord via the cord winding box, and the force transmission between the wound sheet spring and the cord winding box is achieved by gear transmission. The elastic wound sheet is provided inside the wound sheet spring, and the wound sheet may generate the elastic force by winding. A proper wound sheet spring is chosen according to the weight of the window covering curtain to allow the window covering curtain to maintain a balance state of force without being under the effect of an external force, to fix the extending or retracting state of the window covering curtain. If it needs to extend or retract the window covering, it is simply required to poke or pull the curtain to apply an external force, the balance state of force may just be broken, and the automatic extending and retracting of the window covering curtain may then be achieved, which is very convenient. Furthermore, no additional motor or electric control apparatus is required to be provided for this structure, thus doubtlessly reducing the cost of automatically winding the window covering.

BRIEF DESCRIPTION OF THE DRAWINGS

For more clearly illustrating embodiments of the present application or the technical solution in the conventional technology, drawings referred to describe the embodiments or the conventional technology will be briefly described hereinafter. Apparently, the drawings in the following description are only several embodiments of the present application, and for the person skilled in the art other drawings may be obtained based on these drawings without any creative efforts.

REFERENCE NUMERALS IN THE ABOVE FIGURES

10 rotating shaft for curtain state control, 20 rotating shaft for extending and retracting control, 30 wound sheet spring, 31 first transmission gear,
32 second transmission gear, 33 first intermediate transmission gear,
34 spring sheet, 35 elastic force transmission shaft,
40 cord winding box, 41 third transmission gear, -continued

| | |
|---|---|
| 42 fourth transmission gear, | 43 second intermediate transmission gear, |
| 44 curtain pull cord, | 45 winding reel, |
| 50 speed limiter, | 51 fifth transmission gear, |
| 52 sixth transmission gear, | 53 third intermediate transmission gear, |
| 54 speed limiting member, | 55 fastener, |
| 56 first shaft connecting hole, | 57 second shaft connecting hole, |
| 541 connecting portion for speed limiting control, and | |
| 60 curtain state controller. | |

DETAILED DESCRIPTION

It is provided according to an embodiment of the present application a window covering, configured to achieve automatic extending or retracting of a window covering curtain.

For the purpose, the features and the advantages of the present application to be more apparent and readily understood, technical solutions in the embodiments of the present application will be clearly and fully described hereinafter in conjunction with accompanying drawings in the embodiments of the present application. Apparently, the described embodiments are only a part, rather than all, of the embodiments of the present application. All other embodiments obtained by those ordinary skilled in the art based on the embodiments of the present application without making any creative efforts fall within the protection scope of the present application.

The technical solutions of the present application are further described hereinafter in conjunction with drawings and specific embodiments.

Figure 1:
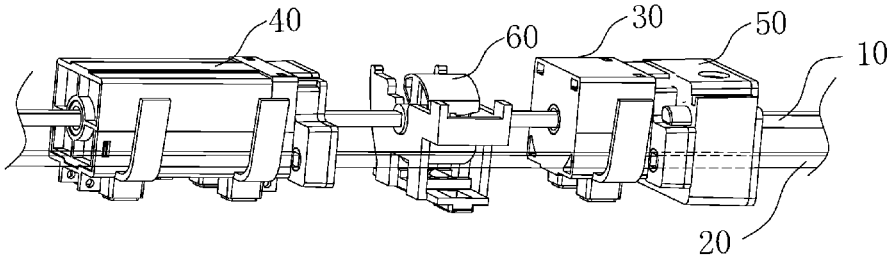
FIG. 1 is a schematic view showing an external structure of a window covering according to an embodiment of the present application.
Figure 2:
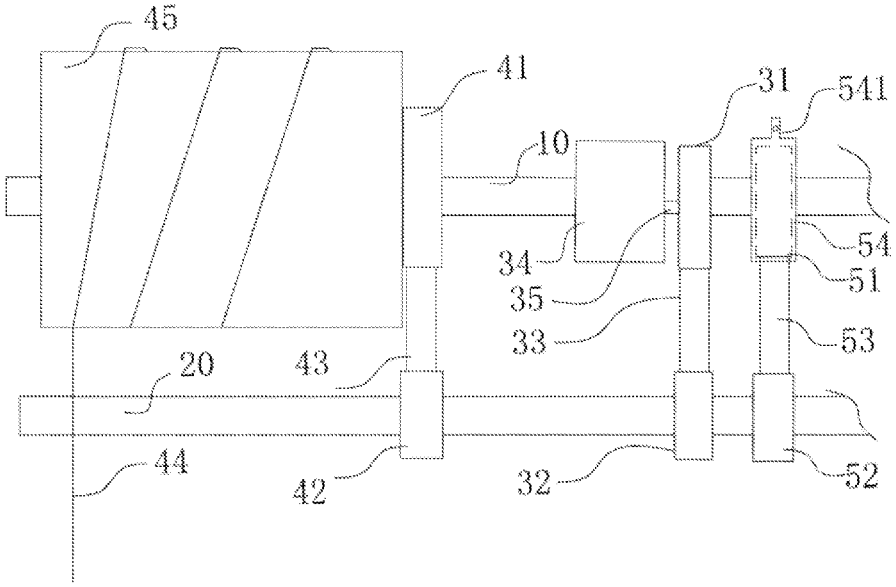
FIG. 2 is a schematic diagram showing the internal structure of a control structure for a curtain pull cord of a window covering according to an embodiment of the present application.

Referring to FIGS. 1 and 2, FIG. 1 is a schematic view showing an external structure of a window covering according to an embodiment of the present application, and FIG. 2 is a schematic diagram showing the implementing principle of a control structure for a curtain pull cord of a window covering according to an embodiment of the present application. The window covering includes: a rotating shaft for curtain state control 10, a rotating shaft for stretching and retracting control 20, a wound sheet spring 30, a cord winding box 40, a speed limiter 50, and a curtain state controller 60.

The cord winding box 40 is wound thereon with a curtain pull cord 44, the curtain pull cord 44 has one end fixed to the cord winding box 40 and another end connected to the window covering curtain, and is configured to control the extending and retracting of a window covering curtain.

Specifically, the implementing principle of the wound sheet spring 30 is similar to that of a mainspring, and an elastic wound sheet is provided inside the wound sheet spring, and the greater a wound extent of the elastic wound sheet is, the greater an elastic force the elastic wound sheet has. The wound sheet spring 30 includes a spring sheet 34, an elastic force transmission shaft 35, a first transmission gear 31, a second transmission gear 32, and a first intermediate transmission gear 33. The spring sheet 34 is wound around the elastic force transmission shaft 35. The first transmission gear 31 is fixedly connected to the elastic force transmission shaft 35. The second transmission gear 32 is sleeved on the rotating shaft for extending and retracting control 20. The first intermediate transmission gear 33 is arranged between the first transmission gear 31 and the second transmission gear 32. The first intermediate transmission gear 33 is connected by meshing to the first transmission gear 31 and the second transmission gear 32 respectively.

The cord winding box 40 includes a winding reel 45, a third transmission gear 41, a fourth transmission gear 42, and a second intermediate transmission gear 43. The winding reel 45 is wound thereon with a curtain pull cord 44 of the window covering. The third transmission gear 41 and the winding reel 45 are fixedly connected. The fourth transmission gear 42 is sleeved on the rotating shaft for extending and retracting control 20. The second intermediate transmission gear 43 is arranged between the third transmission gear 41 and the fourth transmission gear 42. The second intermediate transmission gear 43 is connected by meshing to the third transmission gear 41 and the fourth transmission gear 42 respectively.

The rotating shaft for extending and retracting control 20 rotates to drive the winding reel 45 to rotate via the gear transmission, thus controlling the retracting and extending of the curtain pull cord 44.

Figure 3:
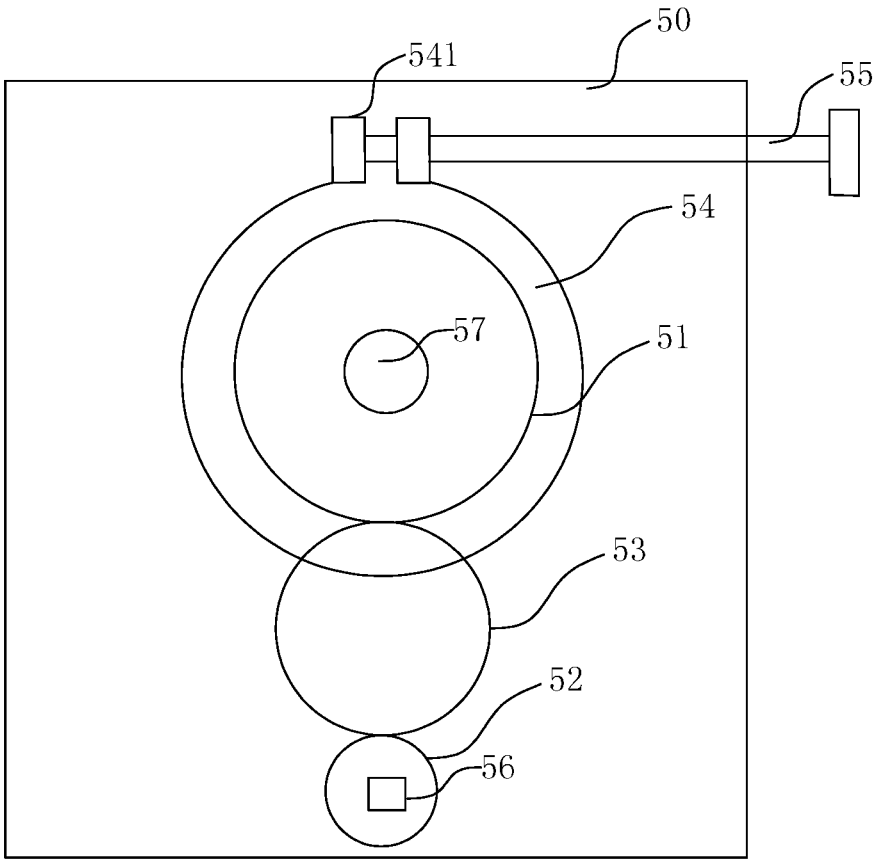
FIG. 3 is a schematic diagram showing an internal structure of a speed limiter according to an embodiment of the present application.

Referring to FIG. 3, FIG. 3 is a schematic diagram showing an internal structure of a speed limiter 50 according to an embodiment of the present application, and is a right view of FIG. 1.

Specifically, the wind covering further includes the speed limiter 50. The speed limiter 50 includes a fifth transmission gear 51, a sixth transmission gear 52, a third intermediate transmission gear 53, a speed limiting member 54, a speed limiting transmission shaft, and a fastener 55.

The sixth transmission gear 52 is provided at a central portion thereof with a first shaft connecting hole 56, and the sixth transmission gear 52 is sleeved on the rotating shaft for extending and retracting control 20. The fifth transmission gear 51 is provided at a central portion thereof with a second shaft connecting hole 57, and the second shaft connecting hole 57 is configured to allow the rotating shaft for curtain state control 10 to pass through the speed limiter 50, but the rotating shaft for curtain state control 10 is not fixedly connected to the speed limiter 50.

In this embodiment, the window covering includes two curtain state controllers 60, which are respectively located at two sides of the rotating shaft for curtain state control 10 or the rotating shaft for extending and retracting control 20. To meet the mounting requirements, the rotating shaft for curtain state control 10 is required to pass through various components, therefore, each of the wound sheet spring 30 and the cord winding box 40 is provided with a through hole similar to the second shaft connecting hole 57, configured to allow the rotating shaft for curtain state control 10 to pass through, however, the wound sheet spring 30 and the cord winding box 40 are not fixedly connected to the rotating shaft for curtain state control 10. It may be appreciated that, multiple curtain state controllers 60 may be provided, which should all fall into the protection scope of the present application.

Specifically, the third intermediate transmission gear 53 is connected by meshing to the sixth transmission gear 52 and the fifth transmission gear 51 respectively. The speed limiting transmission shaft is fixedly connected to the fifth transmission gear 51. The speed limiting member 54 is sleeved on a periphery of the speed limiting transmission shaft. The speed limiting member 54 includes a connecting portion for speed limiting control 541. The fastener 55 is configured to connect the connecting portion for speed limiting control 541.

In this embodiment, considering that it is difficult to perfectly match the elastic force of the wound sheet spring 30 and a weight of the window covering curtain, the elastic force of the wound sheet spring 30 is either greater or less than the weight of the window covering curtain, such that the extent of extending and retracting of the window covering curtain cannot be fixed. Therefore, the speed limiter 50 is provided on the rotating shaft for extending and retracting control 20. The speed limiter 50 can provide a certain resistance for the rotation of the rotating shaft for extending and retracting control 20, to further limit the rotation of the rotating shaft for extending and retracting control 20, and have an effect similar to braking. In this embodiment, the fastener 55 is embodied as a bolt, and by adjusting the tightening extent of the bolt, the extent of the speed limiting member 54 abutting against the periphery of the speed limiting transmission shaft may be appropriately adjusted, and further the resistance of the speed limiting member 54 applied to the speed limiting transmission shaft may be changed, thus is convenient. The speed limiting member 54 is preferably an elastic rubber sheet or an elastic plastic sheet.

In this embodiment, since there are two rotating shafts, i.e., the rotating shaft for curtain state control 10 and the rotating shaft for extending and retracting control 20, a distance between the two rotating shafts may be adjusted according to different requirements. In the case that the distance is too large, it may be required to additionally provide one or even more intermediate transmission gears to perform the transmission, to meet different dimension requirements, which should all fall into the protection scope of the present application.

Specifically, the window covering curtain of the window covering is provided with a pull cord connecting hole; and the curtain pull cord 44 is connected to the window covering curtain via the pull cord connecting hole.

In this embodiment, the window covering is a Venetian blind window covering, and thus the window covering further includes a curtain state controller 60. The curtain state controller 60 is fixedly connected to the rotating shaft for curtain state control 10. The rotating shaft for curtain state control 10 rotates to drive the curtain state controller 60 to rotate. Specifically, the window covering curtain is further provided with a curtain state adjusting ladder cord. The curtain state adjusting ladder cord is connected to the curtain state controller 60. The curtain state controller 60 rotates to drive the curtain state adjusting ladder cord to move up and down, thus may further adjust a state of the window covering curtain, for example, to adjust slats of the window covering curtain to be in a horizontal state or a vertical state.

In this embodiment, in addition to the structures in the above description, the window covering further includes a switch, a packaging housing and other related components, for example a switch or a device configured to control the rotation of the rotating shaft for curtain state control 10, which should all fall into the protection scope of the present application.

In this embodiment, the number of the cord winding boxes 40 is not limited or illustrated, however, it should be appreciated that, the number of the cord winding boxes 40 is generally two, and the two cord winding boxes 40 are respectively located at two ends of the rotating shaft for curtain state control 10, in order to facilitate smooth retracting and extending of the window covering curtain. In some cases, if the window covering curtain is too large, or is too heavy, in addition to providing the cord winding boxes 40 at the two ends of the rotating shaft for curtain state control 10, one or more cord winding boxes 40 may also be added in a middle portion of the rotating shaft for curtain state control 10, to further increase the smoothness of retracting and extending of the window covering curtain, which should all fall into the protection scope of the present application.

In this embodiment, the portion of the wound sheet spring 20 configured to generate a pulling force adopts an elastic wound sheet, which has a low cost and is a preferred implementation. It may be appreciated that, the elastic wound sheet may be replaced by other structures, for example, an electromagnet, and the current flowing through the electromagnet may be associated with a rotating angle, which should all fall into the protection scope of the present application.

In this embodiment, the transmission member is embodied as gear transmission members. It may be appreciated that, the gear transmission may be replaced by other ways of transmission, for example, by a chain transmission, a belt transmission, etc., which should all fall into the protection scope of the present application.

The above description and the above embodiments are only intended to illustrate the technical solutions of the present application, and should not be interpreted as a limitation. Though the present application has been described in detail by referring to the above embodiments, it should be understood by the person skilled in the art that, modifications may be made to the technical solutions set forth in the various embodiments described above, or equivalent substitutions may be made to partial the technical features in the above embodiments; and all these modifications or substitutions do not make the essence of the respective technical solutions depart from the spirit and scope of the technical solutions of the embodiments of the present application.

What is claimed is:

1. A window covering, comprising:

a first rotating shaft configured to control extending and retracting of a curtain pull cord of the window covering, a cord winding box, and at least one wound sheet spring, wherein the wound sheet spring comprises a spring sheet, an elastic force transmission shaft, a first transmission gear and a second transmission gear, the spring sheet is wound around the elastic force transmission shaft, the first transmission gear is fixedly connected to the elastic force transmission shaft, the second transmission gear is connected to the first transmission gear by meshing or at least one first intermediate transmission gear is meshed between the first transmission gear and the second transmission gear, and the second transmission gear is sleeved on the first rotating shaft; and the cord winding box comprises a winding reel, a third transmission gear, and a fourth transmission gear, the curtain pull cord of the window covering is wound on the winding reel, the third transmission gear is fixedly connected to the winding reel, the fourth transmission gear is connected to the third transmission gear by meshing or at least one second intermediate transmission gear is meshed between the third transmission gear and the fourth transmission gear, the fourth transmission gear is sleeved on the rotating shaft, wherein the window covering further comprises a speed limiter, the speed limiter comprises a fifth transmission gear, a sixth transmission gear, an annular speed limiting member, a speed limiting transmission shaft and a fastener, wherein a first shaft connecting hole is provided at a central portion of the sixth transmission gear, and the sixth transmission gear is sleeved on the rotating shaft via the first shaft connecting hole;

the sixth transmission gear is connected to the fifth transmission gear by meshing or at least one third intermediate transmission gear is meshed between the sixth transmission gear and the fifth transmission gear; and the speed limiting transmission shaft is fixedly connected to the fifth transmission gear; and the annular speed limiting member is wrapped on a periphery of the speed limiting transmission shaft, the annular speed limiting member comprises a connecting portion having a protrusion and a hole arranged in the protrusion, and the fastener is connected to the connecting portion by being fastened in the hole arranged in the protrusion.

2. The window covering according to claim 1, wherein the annular speed limiting member is an elastic rubber sheet.

3. The window covering according to claim 1, wherein at least one first intermediate transmission gear is meshed between the first transmission gear and the second transmission gear, and at least one second intermediate transmission gear is meshed between the third transmission gear and the fourth transmission gear, wherein the number of at least one first intermediate transmission gear meshed between the first transmission gear and the second transmission gear is one, and the number of the at least one second intermediate transmission gear meshed between the third transmission gear and the fourth transmission gear is one; and the first intermediate transmission gear is connected by meshing to the first transmission gear and the second transmission gear respectively, and the second intermediate transmission gear is connected by meshing to the third transmission gear and the fourth transmission gear respectively.

4. The window covering according to claim 1, wherein at least one third intermediate transmission gear is meshed between the sixth transmission gear and the fifth transmission gear, and the number of the at least one intermediate transmission gear meshed between the fifth transmission gear and the sixth transmission gear is one; and the third intermediate transmission gear is connected by meshing to the fifth transmission gear and the sixth transmission gear respectively.

5. The window covering according to claim 1, further comprising a window covering curtain, wherein a pull cord connecting hole is provided in the window covering curtain; and the curtain pull cord is connected to the pull cord connecting hole in the window covering curtain.

6. The window covering according to claim 1, further comprising a second rotating shaft configured to control a curtain state and a curtain state controller, wherein a central portion of the fifth transmission gear is provided with a second shaft connecting hole, and the second rotating shaft configured to control the curtain state passes through the second shaft connecting hole;

the curtain state controller is fixedly connected to the second rotating shaft; and the second rotating shaft rotates to drive the curtain state controller to rotate.

* * * * *